US007463843B2

(12) United States Patent
Kawai

(10) Patent No.: US 7,463,843 B2
(45) Date of Patent: Dec. 9, 2008

(54) DEVELOPING DEVICE

(75) Inventor: Hideaki Kawai, Mukoh (JP)

(73) Assignee: Murata Machinery, Ltd., Kyoto (JP)

( * ) Notice: Subject to any disclaimer, the term of this patent is extended or adjusted under 35 U.S.C. 154(b) by 347 days.

(21) Appl. No.: 11/348,649

(22) Filed: Feb. 7, 2006

(65) Prior Publication Data

US 2006/0204273 A1 Sep. 14, 2006

(30) Foreign Application Priority Data

Mar. 9, 2005 (JP) ..... 2005-065893

(51) Int. Cl.
*G03G 15/08* (2006.01)

(52) U.S. Cl. ..... 399/103; 399/105; 399/274; 399/284

(58) Field of Classification Search ..... 399/103, 399/105, 274, 284
See application file for complete search history.

(56) References Cited

U.S. PATENT DOCUMENTS 5,057,868 A 10/1991 Sekino et al.
5,134,960 A * 8/1992 Shirai ..... 399/284
5,870,651 A * 2/1999 Shimada ..... 399/103

FOREIGN PATENT DOCUMENTS

| | | | |
|---|---|---|---|
| JP | 2-44751 U | | 3/1990 |
| JP | 05-107894 | | 4/1993 |
| JP | 06-011958 | | 1/1994 |
| JP | 08106216 A | * | 4/1996 |
| JP | 2000181223 A | * | 6/2000 |
| JP | 2001-289327 | | 10/2001 |

OTHER PUBLICATIONS

Official communication issued in counterpart Japanese Application No. 2005-065893, mailed on Jul. 29, 2008.

* cited by examiner

*Primary Examiner*—David M Gray
*Assistant Examiner*—Ryan D Walsh
(74) *Attorney, Agent, or Firm*—Keating & Bennett, LLP

(57) ABSTRACT

A developing device includes toner, a casing accommodating the toner, a developing roller rotatably fixed on the casing, an elastic blade making contact with a circumferential surface of the developing roller, a seal member, and a cutout portion in the seal member. The seal member is arranged to make contact with a circumferential surface of end portions of the developing roller between the developing roller and a wall surface of the casing and to make contact with an end surface of a tip end of the elastic blade. The cutout portion is arranged on the seal member and is cut out at a potion at a side making contact with a side surface of the tip end of the elastic blade in an axial direction of the developing roller and a side located closer to the wall surface of the casing than the elastic blade in a radial direction of the developing roller.

16 Claims, 5 Drawing Sheets

DEVELOPING DEVICE

BACKGROUND OF THE INVENTION

1. Field of the Invention

The present invention relates to a developing device used in an image forming device. In particular, the present invention relates to a developing device which prevents toner accommodated in a casing from leaking out of the casing from sliding surfaces between end portions of a developing roller and seal members.

2. Description of the Related Art

An image forming device including a developing device is used in a copy machine, a printer, a facsimile machine, and a digital Multi Function Peripheral (MFP) having a plurality of functions such as a copy function, a print function, a FAX communication function and a scanner function. In such an image forming device, a uniformly charged electrophotographic photoconductor is exposed selectively according to image information. An electrostatic latent image formed on the electrophotographic photoconductor is developed by the developing device, and a toner image is provided. When the toner image is transferred onto recording sheet (recording paper), an image recording process is carried out. Then, the unfixed toner image transferred on the recording sheet is fixed onto the recording sheet as a permanent image by a fixing device. In the developing device used in the image forming device, powdered toner is accommodated in a casing. In the casing, the toner is agitated at all times or periodically by an agitator and supplied to a developing roller. When the developing roller rotatably makes contact with a surface of the electrophotographic photoconductor, the electrostatic latent image is developed by the toner.

FIG. 5 illustrates a conventional developing device. An elastic blade 102 makes contact with an image forming region 305 on a surface of a developing roller 101. The elastic blade 102 frictionally charges toner 302 on the developing roller 101 and regulates the thickness of a layer of the toner 302. Therefore, a toner amount retained on the developing roller 101 is regulated. A seal member 104 makes contact with a non-image forming region 306 at each end portion of the developing roller 101. The seal member 104 is adhered on a position of a casing wall surface 103 corresponding to each end portion in an axial direction of the developing roller 101. Both end portions in the axial direction of the developing roller 101 are sealed by the seal members 104 to prevent leakage of the toner 302 from the end portions.

Although not illustrated in the drawings, in another known conventional developing device, a compressive deformation amount of a seal member is greater at an inner portion in an axial direction of a developing roller than end surfaces of the developing roller. In such a developing device, a portion of a casing wall surface where the seal member is mounted is arranged as a slanting surface. The inner portion in the axial direction of the developing roller is located higher than the end surfaces of the developing roller. In addition, the seal member is mounted on the casing wall surface and contacted against the developing roller. Accordingly, it is difficult for the toner 302 to leak from both end portions in the axial direction of the developing roller.

Referring to FIG. 5 again, accompanying the rotation of the developing roller 101, the toner 302, which has failed to pass through a nip portion, moves laterally along a tip end of the elastic blade 102 to the end portions of the developing roller 101 at an upstream side of the elastic blade 102 in a rotational direction of the developing roller 101. In many conventional developing devices, both end portions of the developing roller 101 are sealed by the seal members 104. However, when the toner 302 continuously moves laterally to the end portions of the developing roller 101, an escape route for the toner 302 disappears. Therefore, the toner 302 enters into a sliding surface 105 between the developing roller 101 and the seal member 104. As a result, the toner 302 may leak to the outside of the casing.

In particular, polymerized toner, which has been recently used frequently, has an extremely small particle diameter and has a shape that is close to a complete sphere. Therefore, the toner moves like a liquid and is prone to flow along a circumferential surface of the developing roller 101. Thus, there exists a problem that the toner may leak. The toner that leaks from the developing device causes a deterioration of an image quality or pollutes the surrounding area. In addition, the toner 302 is wasted.

SUMMARY OF THE INVENTION

In order to overcome the problems described above, preferred embodiments of the present invention prevent toner accommodated in a casing from leaking out of the casing from a sliding surface between end portions of a developing roller and a seal member arranged on the developing roller.

According to a preferred embodiment of the present invention, a developing device includes a casing, a developing roller, an elastic blade, a seal member, and a cutout portion in the seal member. The casing accommodates toner. The developing roller is supported rotatably on the casing. The elastic blade makes contact with a circumferential surface of the developing roller. The seal member is arranged so that a side surface of a tip end of the elastic blade makes contact with the seal member. The cutout portion is provided on the seal member. The cutout portion is formed by cutting out a portion at a side making contact with the side surface of the tip end of the elastic blade in an axial direction of the developing roller, and at a side located closer to the casing wall surface than the elastic blade in a radial direction of the developing roller.

According to the above-described developing device, accompanying a rotation of the developing roller, the toner which failed to pass through a nip portion moves laterally along the tip end of the elastic blade at an upstream side of the elastic blade in a rotational direction of the developing roller. However, the laterally moved toner flows once into the cutout portion and returns into the casing again. Therefore, the toner accommodated in the casing is prevented from leaking out of the casing from the sliding surface between the end portions of the developing roller and the seal member.

According to another preferred embodiment of the present invention, the cutout portion is provided from an upstream side to a downstream side of the tip end of the elastic blade in the rotational direction of the developing roller.

According to another preferred embodiment of the present invention, the toner which has moved laterally along the tip end of the elastic blade can flow into the cutout portion and then return into the casing without any difficulty by following a flow of the toner accompanying the rotation of the developing roller.

According to another preferred embodiment of the present invention, the seal member includes a first seal member and a second seal member. A side surface of the first seal member makes contact with the side surface of the elastic blade and makes contact with the circumferential surface of the end portions of the developing roller. The second seal member is arranged between the first seal member and the casing wall surface. The cutout portion is provided in the second seal member.

According to another preferred embodiment of the present invention, the cutout portion can be easily made and the seal member can be easily mounted.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
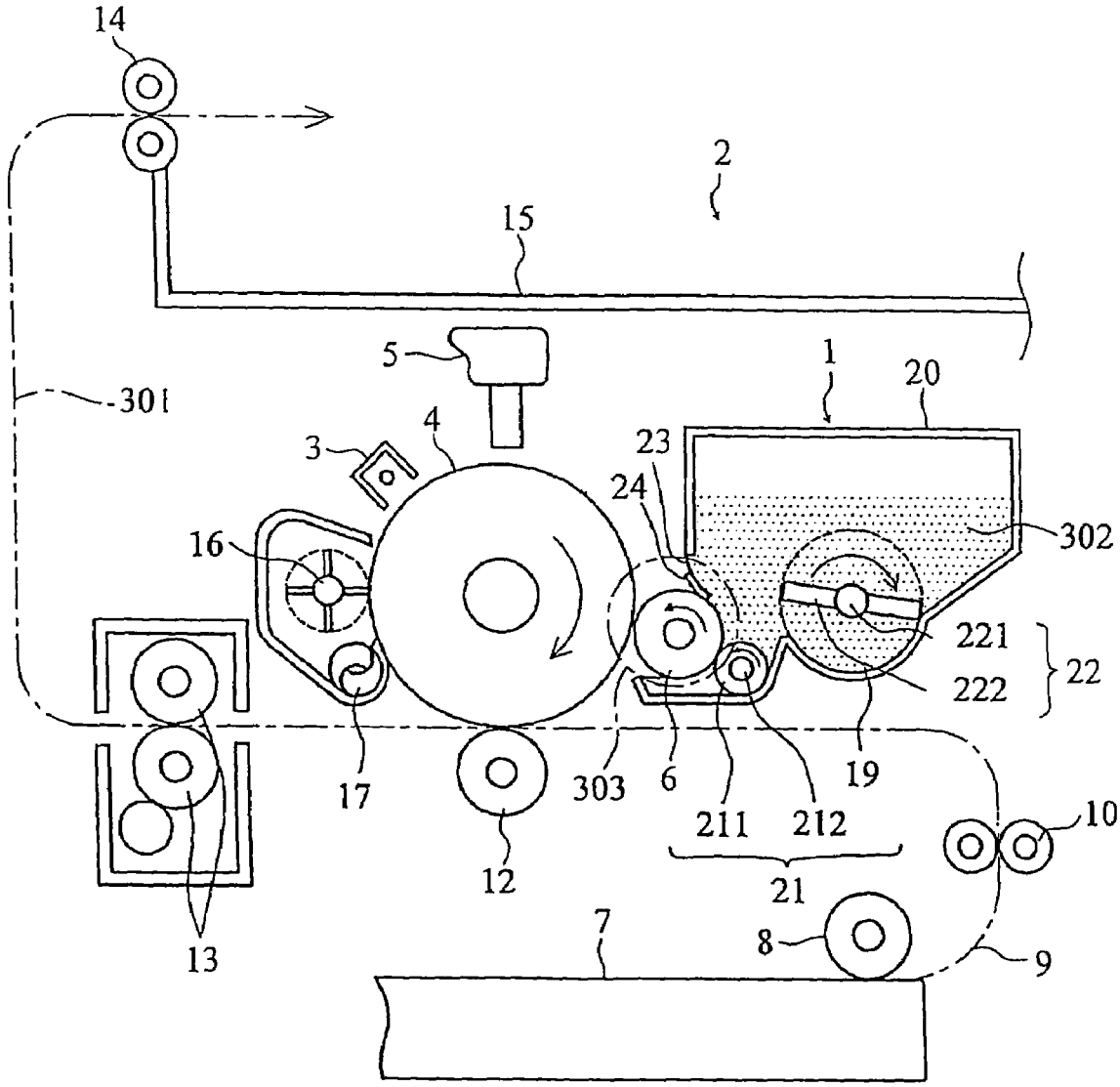
FIG. 1 is a cross-sectional view illustrating an example of an image forming device using a developing device according to a preferred embodiment of the present invention.

With reference to the drawings, a description will be made of a developing device according to preferred embodiments of the present invention. First, with reference to FIG. 1, a description will be made of an image forming device 2 using a developing device 1 according to a preferred embodiment of the present invention. In the image forming device 2, a surface of a photoconductive drum 4 is charged uniformly by a charging device 3. A light image is exposed and an electrostatic latent image is formed on the surface of the rotating photoconductive drum 4 in accordance with image information from a Light Emitting Diode (LED) head 5. Next, toner 302 is supplied to the electrostatic latent image by a developing roller 6. A visible image is formed by the toner 302 on the surface of the photoconductive drum 4 on which the toner 302 is adhered.

Meanwhile, when an image forming process is started, a pickup roller 8 picks up recording paper 301 stacked in a paper feed tray 7 and transports the recording paper 301 into a transportation path 9. The recording paper 301 is transported along the transportation path 9 by transportation rollers 10 arranged appropriately along the transportation path 9. A resist roller (not illustrated) is driven and rotates in synchronism with a formation of the toner image. Accordingly, the recording paper 301 is transported to the photoconductive drum 4. The recording paper 301 transported to the photoconductive drum 4 is pressed against the photoconductive drum 4 by a transfer roller 12. In this case, a voltage of a polarity opposite from a polarity of the toner image on the photoconductive drum 4 is applied to the transfer roller 12. Accordingly, the toner image formed on the surface of the photoconductive drum 4 is transferred onto the recording paper 301.

The recording paper 301 is transported downstream along the transportation path 9. Fixing rollers 13 including a heater (not illustrated) apply pressure and heat to the recording paper 301, and the toner on the recording paper 301 is fixed onto the recording paper 301. Then, the recording paper 301 is output to an output tray 15 by an output roller 14.

A diffusing brush 16 is arranged to make contact with the photoconductive drum 4. The diffusing brush 16 functions to detach the toner 302, paper dust, or the like, remaining on the photoconductive drum 4 and not transferred onto the recording paper 301 from the surface of the photoconductive drum 4. The toner 302 detached from the surface of the photoconductive drum 4 is accommodated into a waste toner box (not illustrated) by a screw type transportation member 17.

Next, a description will be made of a structure of the developing device 1. The developing device 1 includes a casing 20, an agitator 22, a supply roller 21, a developing roller 6, a supporting plate 23, and an elastic blade 24. A toner accumulating portion 19 for accumulating the toner 302 is arranged in the casing 20. The agitator 22 agitates the toner 302 accumulated in the toner accumulating portion 19 and supplies the toner 302 towards the supply roller 21. The supply roller 21 supplies the toner 302 to the developing roller 6. The developing roller 6 develops the latent image on the photoconductive drum 4 by using the toner 302. The supporting plate 23 is fixed on the casing 20. The elastic blade 24 is mounted on the supporting plate 23 and makes contact with the developing roller 6. The developing device 1 may be a developing device including a structure other than the structure described above, and such a developing device shall not be omitted from the scope of the present invention. Alternatively, a process cartridge, in which a developing unit including the developing roller 6 or the like and the photoconductive drum 4 are arranged integrally, may be utilized.

The casing 20 is a container for accommodating the toner 302. As illustrated in FIG. 1, the toner accumulating portion 19 for accumulating the toner 302 is arranged inside the casing 20.

As illustrated in FIG. 1, the agitator 22 agitates the toner 302 accumulated in the toner accumulating portion 19 of the casing 20. Accordingly, the toner 302 is prevented from aggregating, and the toner 302 can be supplied from the toner accumulating portion 19 towards the supply roller 21. The agitator 22 is arranged along a longitudinal direction of the casing 20. The agitator 22 includes a rotational shaft 221 and an agitating blade 222. Both end portions of the rotational shaft 221 are supported rotatably on a wall portion of the casing 20. The agitating blade 222 is a thin plate-shaped member protruding from the rotational shaft 221 in a radial direction of the rotational shaft 221. A gear (not illustrated) is mounted on one end of the rotational shaft 221. During an agitating operation, power is transmitted from a drive source (not illustrated) to the gear, and the agitating blade 222 rotates with the rotational shaft 221 about the axial direction of the rotational shaft 221. Accordingly, the powder toner 302 accommodated in the casing 20 is agitated.

As illustrated in FIG. 1, a roller shaft 212 is inserted through a resilient member 211 (roller main body) having a hollow tubular shape to form the supply roller 21. The toner 302 supplied from the toner accumulating portion 19 by the agitator 22 is trapped by the resilient member 211 and supplied to the developing roller 6. An end portion of the roller shaft 212 of the supply roller 21 is mounted rotatably on the wall portion of the casing 20.

Figure 2:
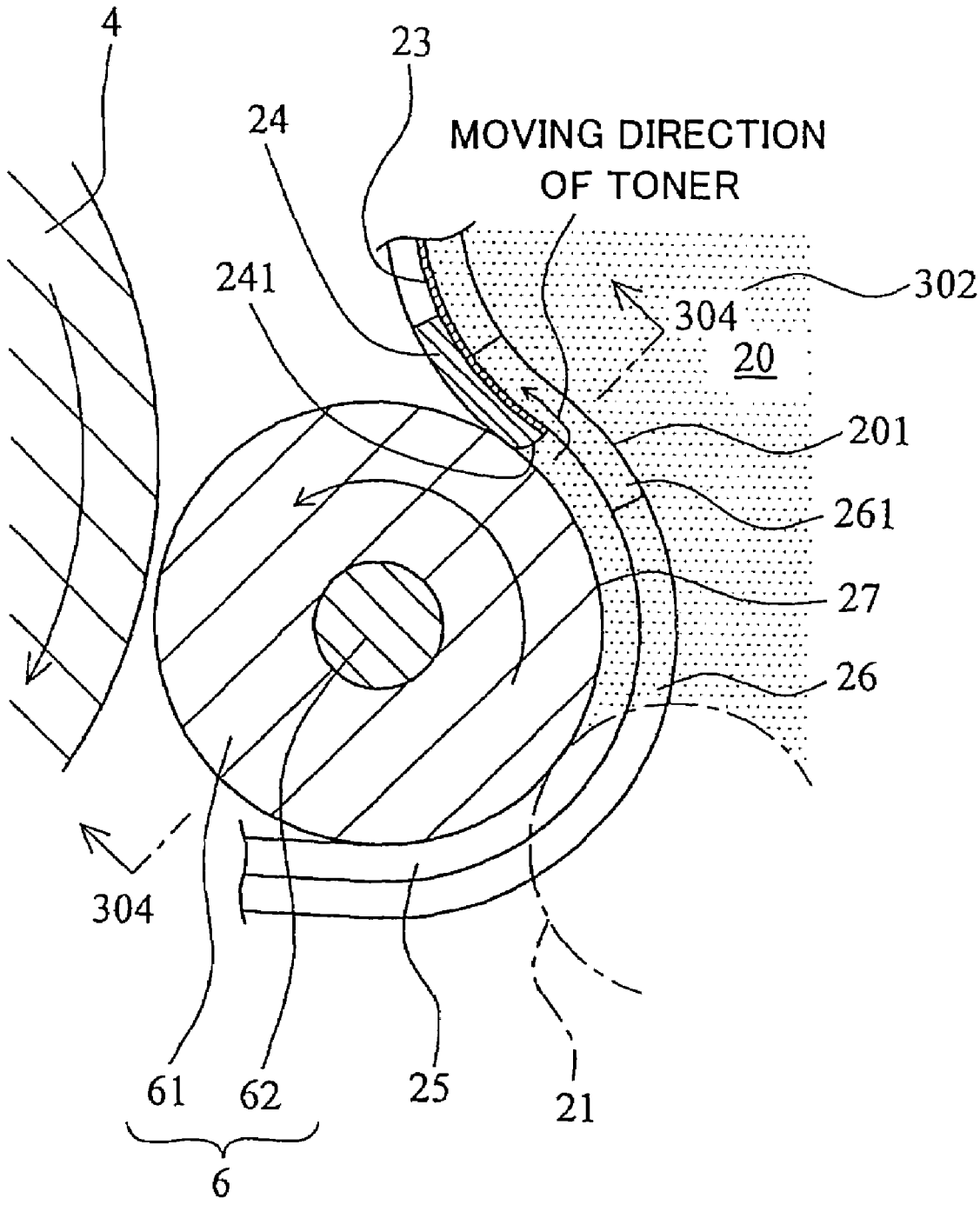
FIG. 2 is an enlarged view of an area indicated by a reference numeral 303 in FIG. 1.

As illustrated in FIG. 2, a roller shaft 62 is inserted though a resilient member 61 (roller main body) to form the developing roller 6. The resilient member 61 has a hollow tubular shape and a smooth surface. The toner 302 is carried on the surface of the developing roller 6. The carried toner 302 is supplied to the photoconductive drum 4, and the latent image on the surface of the photoconductive drum 4 is visualized by the toner 302. That is, the developing roller 6 functions as a developing unit. End portions of the roller shaft 62 of the developing roller 6 are mounted rotatably on the wall portion of the casing 20. A rotational drive force is transmitted from a drive source (not illustrated) to a gear (not illustrated) fixed on one end of the roller shaft 62, and the developing roller 6 rotates.

At the same time as the developing roller 6 functions as the developing unit, the developing roller 6 can also function as a cleaning unit. That is, in a first rotation of the photoconductive drum 4 after the photoconductive drum 4 starts rotating, the developing roller 6 functions as the developing unit. In a second rotation and thereafter of the photoconductive drum 4, the developing roller 6 functions to remove the toner 302 remaining on the photoconductive drum 4. The removed toner 302 is toner remaining on the surface of the photoconductive drum 4 not transferred onto the recording paper 301 or detached from the surface of the photoconductive drum 4 by an operation of the diffusing brush 16. By providing the developing roller 6 as both the developing unit and the cleaning unit, there exists an advantage that a cleaning unit is not required to be provided separately and that the costs can be reduced. In the above-described preferred embodiment, the roller main body of the developing roller 6 is a resilient member 61. However, the present invention is not limited to such an example. If a surface layer of the roller main body is smooth, such a roller main body may be utilized. For example, the roller main body of the developing roller 6 may be a roller on which fluorine is coated over a surface layer of a silicon member or may be a solid roller.

The supporting plate 23 is preferably a stainless steel plate-shaped member. As illustrated in FIG. 1, one end of the supporting plate 23 is fixed on the casing 20, and the elastic blade 24 is mounted on the other end of the supporting plate 23.

As illustrated in FIG. 1 through FIG. 4, a reverse surface of the elastic blade 24 is mounted on the supporting plate 23. One end of a front surface of the elastic blade 24 is arranged to make contact with an image forming region 305 on the circumferential surface of the developing roller 6 in an opposite direction with respect to the rotation of the developing roller 6. A tip end 241 of the elastic blade 24 is located at one end of the front surface of the elastic blade 24 in an upstream side of the rotational direction of the developing roller 6. The elastic blade 24 is made of a flexible rubber or elastomeric material, such as urethane or silicon. The elastic blade 24 frictionally charges the toner 302 on the developing roller 6 and regulates a thickness of a layer of the toner 302. By regulating the toner amount retained on the developing roller 6, the toner 302 adhered on the developing roller 6 is equalized and a thin toner layer is provided.

Figure 3:
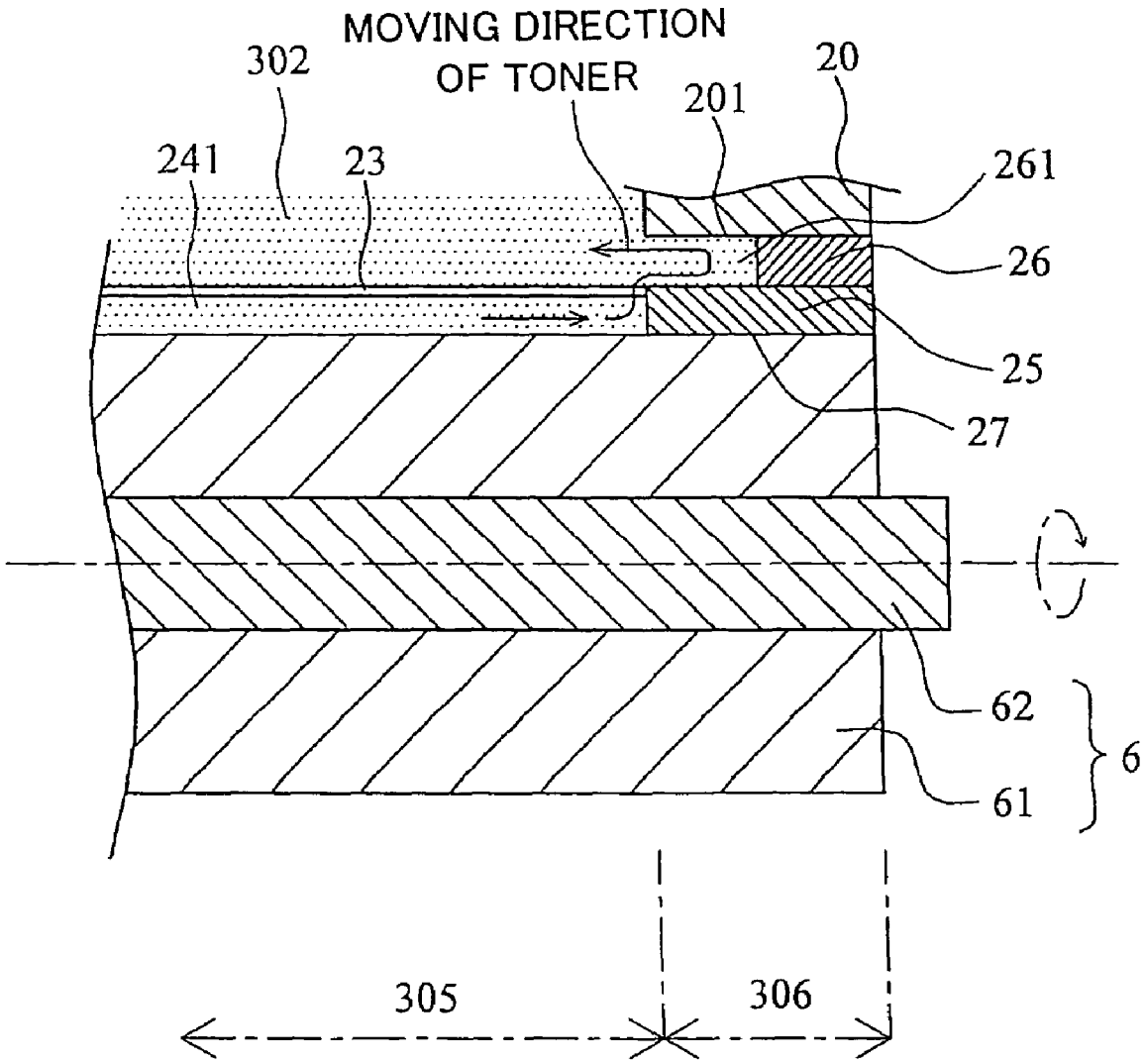
FIG. 3 is a cross-sectional view taken along arrows 304 in FIG. 2.

As illustrated in FIG. 3, the developing roller 6 is sealed at non-image forming regions 306 at both end portions in the axial direction by a first seal member 25 and a second seal member 26 so that the toner 302 does not leak from the both end portions.

Figure 4:
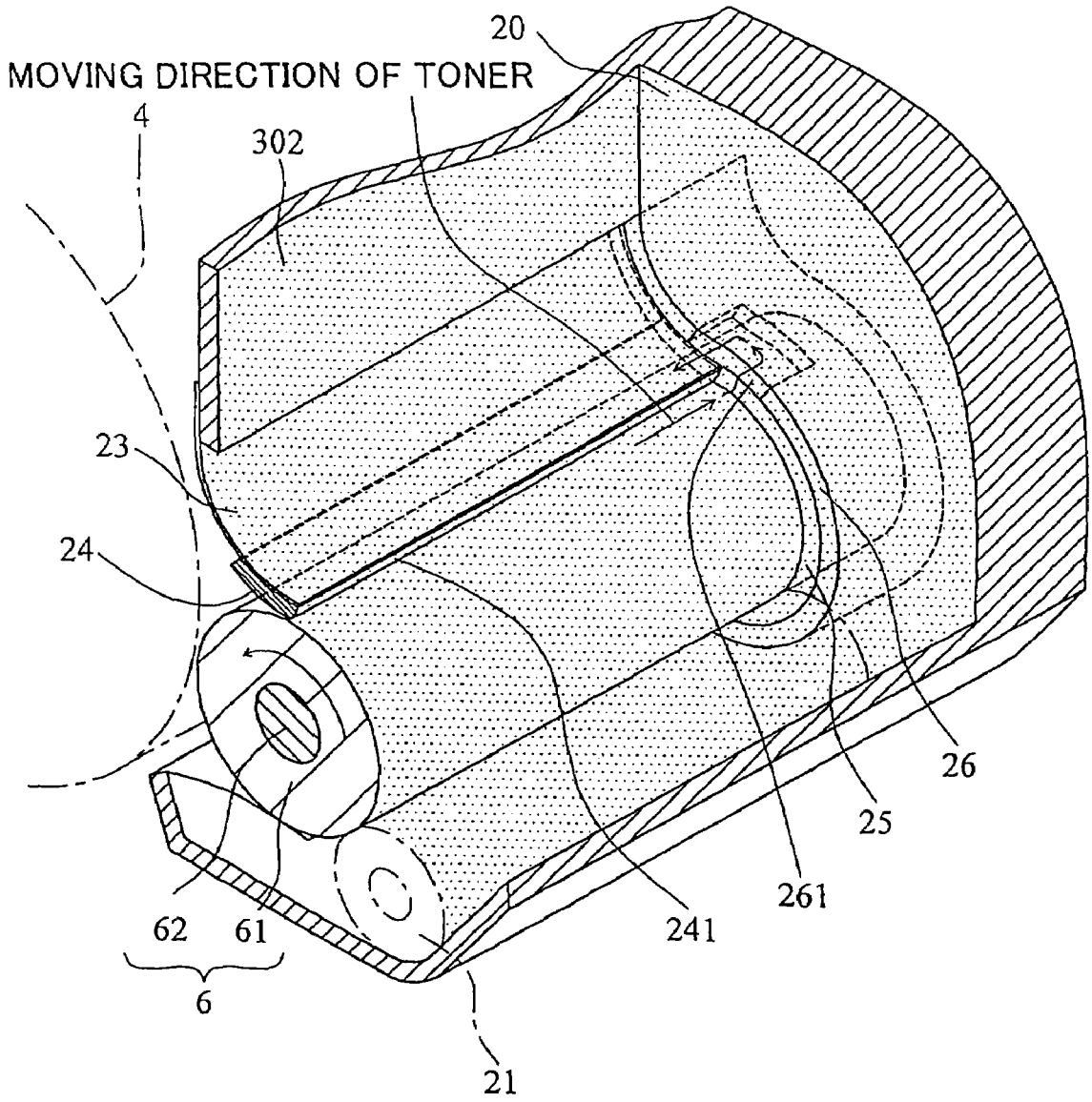
FIG. 4 is a perspective view illustrating an example of a structure of a developing roller, a supporting plate, an elastic blade, a first seal member, and a second seal member.
Figure 5:
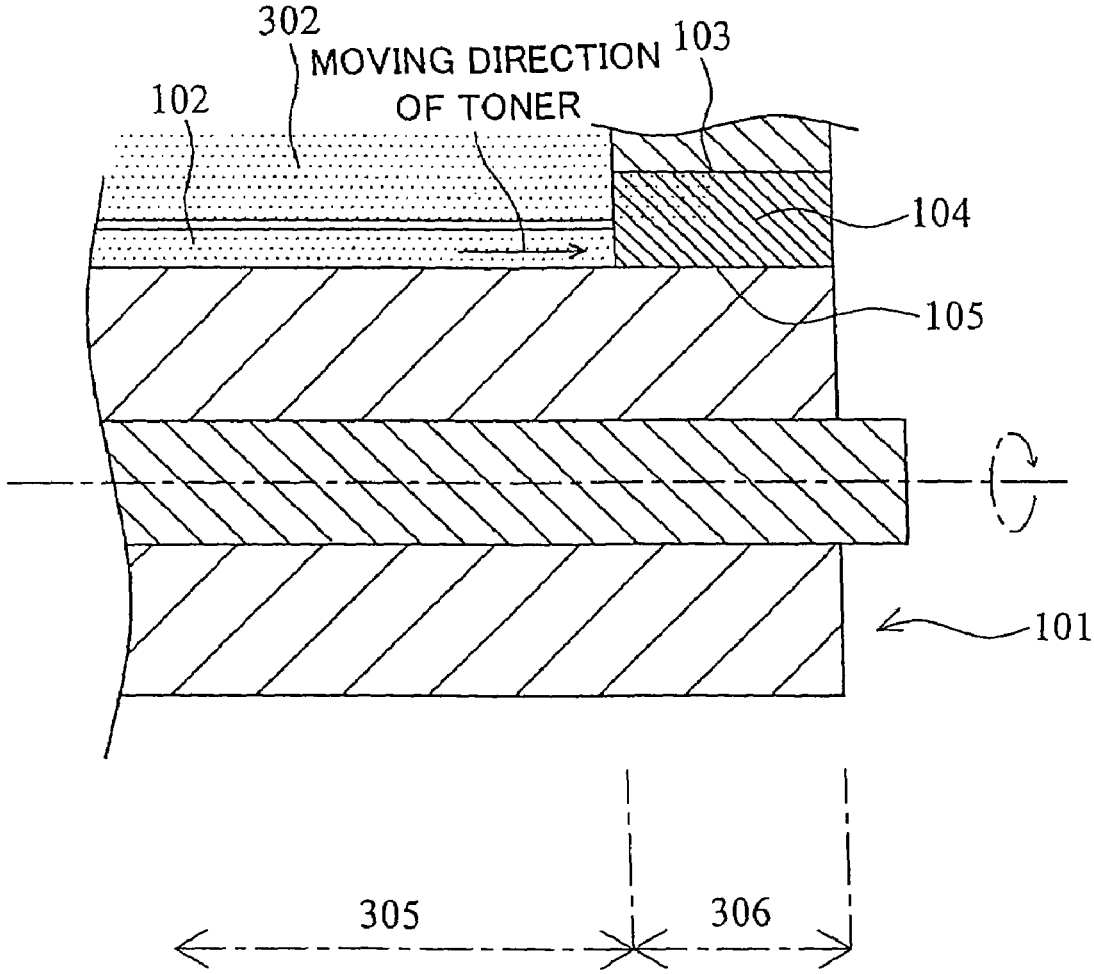
FIG. 5 PRIOR ART
FIG. 5 is a cross-sectional view illustrating an example of a structure of a developing roller, an elastic blade, and a seal member of a conventional developing device.

The first seal member 25 and the second seal member 26 are preferably made of a resilient, sponge-like or foam-like material, or other suitable material. The first seal member 25 makes contact with the non-image forming regions 306 at both end portions in the axial direction of the developing roller 6. As illustrated in FIG. 3 and FIG. 4, a side surface of the supporting plate 23 and the elastic blade 24 make contact with the side surface of the first seal member 25.

The second seal member 26 is arranged between the first seal member 25 and a casing wall surface 201. That is, the second seal member 26 is located closer to the casing wall surface 201 than the elastic blade 24 in the radial direction of the developing roller 6. A cutout portion 261 is arranged in the second seal member 26. As illustrated in FIG. 2 and FIG. 4, the cutout portion 261 is arranged in a portion of a side in proximity to a side surface of the tip end 241 of the elastic blade 24 in the axial direction of the developing roller 6 and from an upstream side to a downstream side of the tip end 241 of the elastic blade 24 in the rotational direction of the developing roller 6. That is, the cutout portion 261 defines a space between the first seal member 25 and the casing wall surface 201 from the upstream side to the downstream side of the tip end 241 of the elastic blade 24. Accompanying the rotation of the developing roller 6, the toner 302, which failed to pass through a nip portion, moves laterally along the tip end 241 of the elastic blade 24. The toner 302, which has moved laterally, flows into the cutout portion 261. That is, the cutout portion 261 provides an escape path for the toner 302.

Next, a description will be made of the flow of the toner 302 accommodated in the casing 20 of the developing device 1. The toner 302 accommodated in the casing 20 is accumulated in the toner accumulating portion 19. The toner 302 is agitated by the rotation of the agitator 22 and fed to the supply roller 21. Then, the toner 302 is supplied by the supply roller 21 to the developing roller 6 rotating in proximity to the photoconductive drum 4. The developing roller 6 develops the electrostatic latent image on the surface of the photoconductive drum 4 with the toner 302.

In this case, as illustrated in FIG. 3 and FIG. 4, accompanying the rotation of the developing roller 6, the toner 302, which failed to pass through the nip portion, eventually moves laterally along the tip end 241 of the elastic blade 24 towards the sealed end portions of the developing roller 6 at the upstream side of the elastic blade 24 in the rotational direction of the developing roller 6. The toner 302, which has moved laterally, contacts the side surface of the first seal member 25. The toner 302 more easily flows into the cutout portion 261 of the second seal member 26 rather than into the sliding surface 27 between the end portion of the developing roller 6 and the first seal member 25. By following the flow of the toner 302 in the cutout portion 261 accompanying the rotation of the developing roller 6, the toner 302 moves from the upstream side to the downstream side of the tip end 241 of the elastic blade 24.

Therefore, without building up pressure from the toner 302 moving laterally along the tip end 241 of the elastic blade 24, the toner 302 can easily move into the casing 20 again. As described above, since an escape path of the toner 302 is provided by the cutout portion 261, the laterally moving toner 302 does not enter into the sliding surface 27 between the end portion of the developing roller 6 and the first seal member 25 and leak outside from the casing 20.

Further, the present invention shall not be limited to the above-described preferred embodiments. Various modifications maybe made without departing from the scope of the present invention. For example, in the above-described preferred embodiments, the seal member sealing the end portions of the developing roller 6 preferably includes two members, i.e., the first seal member 25 and the second seal member 26. However, the end portions of the developing roller 6 may be sealed by an integral seal member or by at least three members resulting in a similar shape as the two members.

The present invention is applicable to a developing device used in an image forming device such as a copy machine, a printer, a facsimile machine, and a digital MFP.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. A developing device comprising:

a toner;

a casing arranged to accommodate the toner;

a developing roller fixed rotatably on the casing;

an elastic blade in contact with a circumferential surface of the developing roller;

a seal member arranged between the developing roller and a wall surface of the casing, the seal member in contact with the circumferential surface of an end portion of the developing roller and a side surface of a tip end of the elastic blade; and a cutout portion provided in the seal member at a side surface of the seal member making contact with the side surface of the tip end of the elastic blade and in a side located closer to the wall surface of the casing than the elastic blade in a radial direction of the developing roller; wherein the seal member includes a first seal member arranged to make contact with the circumferential surface of both end portions of the developing roller so that a side surface of the first seal member makes contact with the side surface of the elastic blade, and a second seal member arranged between the first seal member and the wall surface of the casing, the second seal member having the cutout portion.

2. The developing device according to claim 1, wherein the cutout portion is arranged to extend from an upstream side to a downstream side of the tip end of the elastic blade in a rotational direction of the developing roller.

3. The developing device according to claim 1, wherein the first seal member is made of a resilient material.

4. The developing device according to claim 1, wherein the second seal member is made of a resilient material.

5. The developing device according to claim 1, wherein the seal member is made of one of a resilient material, a sponge material or a foam material.

6. The developing device according to claim 1, further comprising a supporting plate fixed on the casing, wherein the elastic blade is mounted on the supporting plate.

7. The developing device according to claim 6, wherein a front surface of the tip end of the elastic blade makes contact with an image forming region on the circumferential surface of the developing roller and the tip end of the elastic blade extends in a direction opposite to a direction of rotation of the developing roller.

8. The developing device according to claim 1, wherein the elastic blade is made of an elastomeric material.

9. An image forming device comprising:

a rotatable photoconductive drum;

a charging device arranged to uniformly charge a surface of the photoconductive drum;

an exposing device arranged to expose a light image and form an electrostatic latent image on the charged surface of the photoconductive drum in accordance with image information; and a developing device arranged to supply toner to the electrostatic latent image and form a visible image by the toner on the surface of the photoconductive drum, the developing device including:

a toner;

a casing accommodating the toner;

a developing roller fixed rotatably on the casing;

an elastic blade in contact with a circumferential surface of the developing roller;

a seal member arranged between the developing roller and a wall surface of the casing, the seal member in contact with the circumferential surface of an end portion of the developing roller and a side surface of a tip end of the elastic blade; and a cutout portion provided in the seal member at a side surface of the seal member making contact with the side surface of the tip end of the elastic blade and in a side located closer to the wall surface of the casing than the elastic blade in a radial direction of the developing roller; wherein the seal member includes a first seal member arranged to make contact with the circumferential surface of both end portions of the developing roller so that a side surface of the first seal member makes contact with the side surface of the elastic blade, and a second seal member arranged between the first seal member and the wall surface of the casing, the second seal member having the cutout portion.

10. The image forming device according to claim 9, wherein the cutout portion is arranged to extend from an upstream side to a downstream side of the tip end of the elastic blade in a rotational direction of the developing roller.

11. The image forming device according to claim 9, wherein the first seal member is made of a resilient material.

12. The image forming device according to claim 9, wherein the second seal member is made of a resilient material.

13. The image forming device according to claim 9, wherein the seal member is made of one of a resilient material, a sponge material or a foam material.

14. A method for preventing toner from leaking out of a casing of a developing device, the method comprising the steps of:

providing a developing roller, an elastic blade having a tip end in contact with a circumferential surface of the developing roller, and a seal member sealing end portions of the developing roller;

laterally moving toner along the tip end of the elastic blade to the sealed end portions of the developing roller at an upstream side of the elastic blade in a rotational direction of the developing roller;

contacting the laterally moved toner with a side surface of a first seal member of the seal member; and flowing the toner into a cutout portion of a second seal member more easily than the toner would move into a sliding surface between the end portions of the developing roller and the first seal member.

15. The method according to claim 14, wherein the step of flowing the toner includes moving the toner from an upstream side to a downstream side of the tip end of the elastic blade by following a flow of the toner in the cutout portion.

16. The method according to claim 15, wherein the step of flowing the toner into the cutout portion includes moving the toner back into the casing.

* * * * *